US006276075B1

(12) United States Patent
Kost et al.

(10) Patent No.: US 6,276,075 B1
(45) Date of Patent: Aug. 21, 2001

(54) SNOWPLOW BLADE SUPPORT APPARATUS

(75) Inventors: James A. Kost, Willoughby; Robert L. Potak, Strongsville, both of OH (US)

(73) Assignee: The Louis Berkman Company, Steubenville, OH (US)

( * ) Notice: Subject to any disclaimer, the term of this patent is extended or adjusted under 35 U.S.C. 154(b) by 0 days.

(21) Appl. No.: 09/465,887

(22) Filed: Dec. 17, 1999

(51) Int. Cl.[7] ..... E01H 5/04
(52) U.S. Cl. ..... 37/231; 172/274
(58) Field of Search ..... 37/231, 232, 234, 37/235, 236, 270; 172/127, 259, 275, 260.5, 272, 413, 274, 459, 666, 705, 799.5, 772, 815

(56) References Cited

U.S. PATENT DOCUMENTS

| | | | | |
|---|---|---|---|---|
| 3,353,287 | | 11/1967 | King . | |
| 3,400,475 | | 9/1968 | Peitl . | |
| 3,432,946 | | 3/1969 | Peitl . | |
| 3,432,947 | | 3/1969 | Peitl . | |
| 3,706,144 | | 12/1972 | Miceli . | |
| 3,828,449 | | 8/1974 | Miceli . | |
| 4,528,762 | | 7/1985 | Sarka et al. . | |
| 4,803,790 | | 2/1989 | Ciula . | |
| 4,976,054 | * | 12/1990 | Jones | 37/235 |
| 5,806,214 | * | 9/1998 | Behrens et al. | 37/231 |
| 5,870,839 | * | 2/1999 | Wissmiller | 37/231 |
| 5,899,007 | * | 5/1999 | Niemela et al. | 37/281 |
| 6,050,008 | * | 4/2000 | Doornek et al. | 37/231 |
| 6,145,222 | * | 11/2000 | Curtis | 37/231 |

* cited by examiner

*Primary Examiner*—Robert E. Pezzuto
(74) *Attorney, Agent, or Firm*—Vickers, Daniels & Young

(57) ABSTRACT

An apparatus is provided for mounting a snowplow blade onto a vehicle-mounted supporting frame. The mounting apparatus includes an I-beam support member pivotally attached to the blade and removably mountable on the vehicle-mounted supporting frame. Connections are provided on the support member for controlling the angle of the support member with regard to the supporting frame, and for installing springs between the support member and the blade for dampening the impact of obstructions encountered by the blade. A caster or skid system is provided, having cost effective, low maintenance vertical adjustment using reconfigurable spacers to support a snowplow blade a certain vertical distance above the road surface, and easy adjustment of the vertical distance.

48 Claims, 8 Drawing Sheets

SNOWPLOW BLADE SUPPORT APPARATUS

The present invention relates to the art of mounting snowplows to automotive vehicles, and more particularly an apparatus for mounting a snowplow blade on a vehicle-mounted snowplow supporting frame attached to a vehicle equipped with controls for positioning the frame and the snowplow blade.

INCORPORATION BY REFERENCE

The invention finds particular utility in connection with snowplows and mounting structures of the type disclosed in U.S. Pat. No. 3,353,287 to King; U.S. Pat. No. 3,400,475 to Peitl; U.S. Pat. No. 3,432,946 to Peitl; U.S. Pat. No. 3,432,947 to Peitl; U.S. Pat. No. 3,706,144 to Miceli; U.S. Pat. No. 3,828,449 to Miceli; U.S. Pat. No. 4,528,762 to Sarka, et al.; and U.S. Pat. No. 4,803,790 to Ciula, owned by the assignee of the present invention, and the disclosures of which are hereby incorporated herein by reference as background information. Accordingly, the invention will be disclosed and described in detail herein in conjunction with a snowplow and various supporting frame hardware typical of those disclosed in the above referenced patents. It will be appreciated, however, that the present invention can be applied to other styles and types of snowplows and supporting frames.

BACKGROUND OF THE INVENTION

In the snowplow systems shown in the above patents, the blade is supported on a vehicle using a pivotal mounting frame allowing an operator to pivot the blade about a vertical axis and thereby to selectively direct the plowed snow to either side of the vehicle path. Such mounting frames are generally mounted on a vehicle for pivoting about a horizontal axis near the front of the vehicle whereby the plow blade may also be selectively raised and lowered using hydraulic controls mounted on the vehicle. The plow blade itself is typically attached to the mounting frame for limited rotation about a horizontal mounting axis near the plow blade and is further equipped with springs connected between the blade and the mounting frame to dampen this rotational movement and to bias the blade to an upright position. In addition, the blade may optionally be offset from the ground using skids or casters mounted to the mounting frame. This is particularly desirable for heavy highway plows to minimize damage to the road surface. The above patents illustrate various structures by which snowplow blades have heretofore been supported on such mounting frames. In Miceli U.S. Pat. No. 3,828,449, the blade is mounted on a U-shaped support member using trunnions 40 and 42 as shown in FIG. 2. The support member provides manual adjustment of the blade angle about a center pin 46 and lock 48. Springs 44 are connected between the blade and the support member to hold the blade upright and to dampen the pivoting of the blade about the trunnion axis as the blade contacts obstacles. Miceli U.S. Pat. No. 3,706,144 also illustrates an arcuate snowplow blade support member in FIG. 1. In this arrangement, the arcuate member forms a sector and a long pin pivotally interconnects the blade and support member. Hydraulic control of the blade angle is provided using rams 2 and 3. In King U.S. Pat. No. 3,353,287, the snowplow blade support system includes a C-shaped channel member pivotally attached to the blade with pins, forming a sector arrangement with an arcuate plate member 25. This configuration further includes two horizontal V-shaped brace members between the arcuate member and the C-shaped channel member. Manual adjustment of the blade angle is disclosed, wherein the blade pivots around axis 14 through the C-shaped channel member and is locked in a desired position. In Ciula U.S. Pat. No. 4,803,790, a C-shaped support member 26 is illustrated having no arcuate supporting structure. In applications employing light weight snowplow blades, as disclosed in Ciula, a single C-shaped support member has proven adequate. However, larger and/or more massive snowplow blades require more supporting strength, particularly for highway plowing applications where the vehicle speed exceeds that of typical parking lot or driveway operations. Adding further supporting braces and members, as shown in the Miceli and King patents, adds further cost, complexity, and weight to the system. Other methods of strengthening the C-shaped support member of Ciula include selection of different materials and increasing the thickness. These methods, however, further add to the cost and weight of the blade support apparatus, and are therefore undesirable. Optional support for vehicle snowplow blades is provided by skids as shown in U.S. Pat. Nos. 3,400,475; 3,432,946; and 3,432,947 to Peitl, or by casters as shown in U.S. Pat. No. 4,528,762 to Sarka, et al. In these systems, the skid or caster may be vertically adjusted by rotating a threaded shaft such as is shown in Peitl U.S. Pat. No. 3,400,475, and fixed by tightening a nut on the shaft. Alternatively, the vertical spacing between the skids or casters and the plow blade may be adjusted using a vertical skid shaft inserted within a vertical supporting plate, wherein horizontal holes are provided in the shaft and the plate for receiving a pin, as shown in Peitl U.S. Pat. No. 3,432,946. The use of a threaded shaft is an expensive method, as threaded surfaces must be provided both in the shaft as well as in the vertical structure to which the shaft is mounted. Horizontal holes and pins in combination provide relatively inexpensive vertical adjustment for skids or casters. However, such a pin must bear the vertical load of the snowplow mass, which can be very large for highway plows and the like. The pin must therefore be sized to accept the shear forces caused by the snowplow load. It is therefore desirable to provide a system for vertical adjustment of snowplow blade supporting skids, rollers, or casters which provides adequate vertical load handling capabilities with little or no increase in cost or complexity over the prior systems.

SUMMARY OF THE INVENTION

In accordance with the present invention, there is provided a snowplow blade supporting apparatus by which the foregoing and other problems and disadvantages are overcome or minimized. More particularly, and in accordance with the principal aspect of the present invention, there is provided a snowplow blade mounting apparatus which includes an I-beam support member adapted to support a typical highway or smaller snowplow for damped limited pivotal movement about a horizontal axis. In this regard, the single support I-beam member has higher load carrying capabilities and lower torsional flexure than a similarly sized C-shaped channel member of the same weight and thickness. Moreover, the flanges of the I-beam overhang both sides of the beam web, thus providing additional weld points on the inwardly facing flange surfaces of both sides. As such, clevis plates may be welded to both the I-beam web and the flange of both sides of the I-beam to provide superior weld joint strength over a weld to the web alone. In addition, the apparatus provided occupies no more space than devices existing heretofore.

In accordance with another aspect of the present invention, the snowplow blade supporting apparatus includes a pivotal mounting adapted for connection with a typical vehicle mounted supporting frame, and allowing controlled pivotal movement of the blade with respect to the supporting frame about a vertical axis.

In accordance with a further aspect of the invention, the support member includes a control connector for attachment of a hydraulic ram or other controls, allowing a vehicle operator to adjust the snowplow blade angle from inside the vehicle.

In accordance with yet another aspect of the invention, the support member further includes a bracket adapted for connection to a spring, whereby the spring may be connected between the support member and the blade.

In accordance with still another aspect of the present invention, there is provided a caster mounted on the support member which is vertically adjustable with respect to the support member.

It is accordingly a primary object of the present invention to provide an improved snowplow mounting apparatus by which a snowplow blade may be mounted on a vehicle equipped with a blade supporting frame.

Another object of the present invention is the provision of an improved snowplow mounting apparatus of the character described above which includes a single blade support member.

Yet another object of the present invention is the provision of an improved snowplow mounting apparatus of the character described above which is stronger than a C-shaped apparatus of similar size and weight.

Still another object of the present invention is the provision of an improved snowplow mounting apparatus of the character described above which includes a simple, low-cost vertically adjustable caster system.

BRIEF DESCRIPTION OF THE DRAWINGS

The foregoing and other objects and advantages of the present invention will become apparent from the following description of a preferred embodiment of the invention illustrated in the accompanying drawings which form a part thereof and in which.

DESCRIPTION OF A PREFERRED EMBODIMENT

Figure 1:
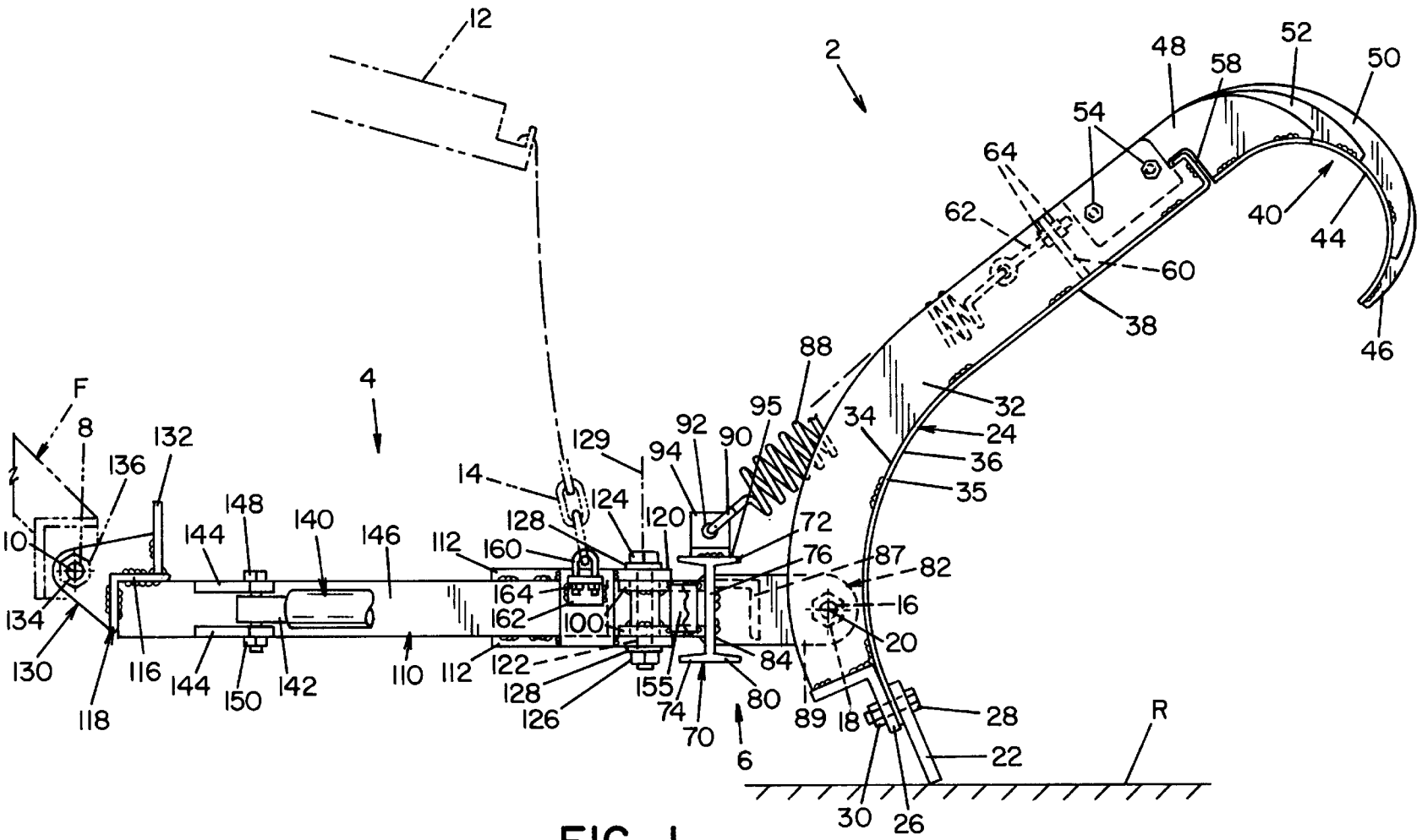
FIG. 1 is a side elevation view of one embodiment of a vehicle snowplow mounting system including a support member in accordance with the present invention.
Figure 2:
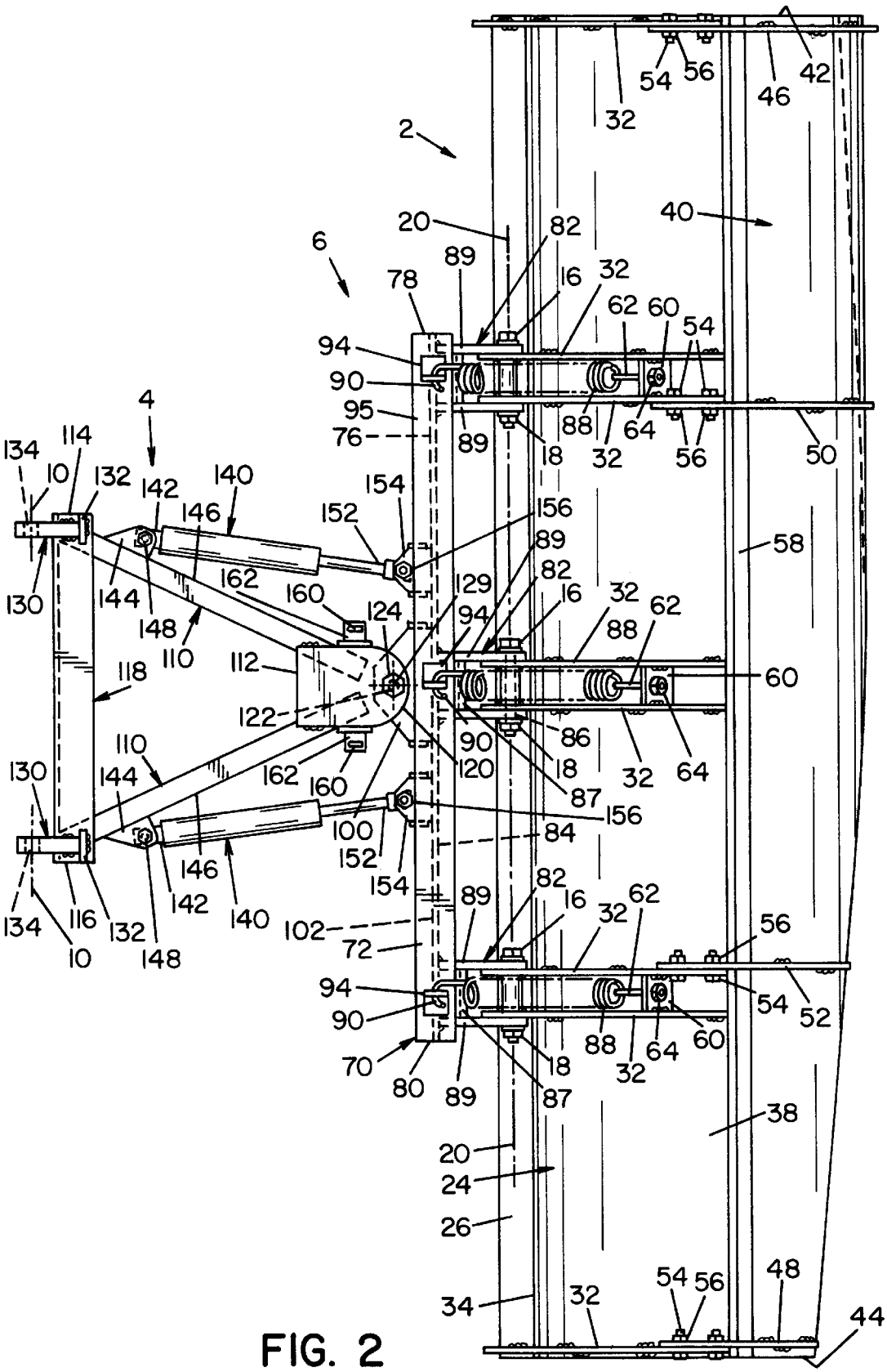
FIG. 2 is a plan view of a vehicle snowplow mounting system including a support member in accordance with the present invention.

Referring now to the drawings wherein the showings are for the purpose of illustrating preferred embodiments of the present invention only, and not for the purpose of limiting the same, FIGS. 1 and 2 show a snowplow 2 mounted on a supporting frame 4 using mounting apparatus 6. Supporting frame 4 is pivotally mounted on a vehicle, not shown, having a frame F using pins 8 which provide a horizontal pivot axis 10 allowing snowplow 2 to be selectively raised and lowered using lift arm 12 and chain 14. Snowplow 2 is mounted on mounting apparatus 6 using bolts 16 and nuts 18 for pivotal movement with respect to apparatus 6 about horizontal axis 20. Alternatively, pins and flip pins, not shown, may be used instead of bolts 16 and nuts 18. Snowplow 2 includes a scraper blade 22 mounted on a main blade 24 by an L-shaped mounting leg 26 on blade 24 and bolts 28 threadingly engaging nuts 30. Snowplow 2 further includes braces 32 welded to main blade 24 along the back surface 34 of the blade. Main blade 24 has an arcuate portion 35 defining a concave front surface 36, and a flat portion 38 extending upwardly therefrom to a curved snow deflector 40. Deflector 40 is tapered from left side 42 to right side 44 as shown in FIG. 2, thus directing plowed snow more effectively toward the right side of the plowing path in a typical road plowing operation. Many different tapered deflector contours are possible for directing plowed snow in a predetermined fashion such as, for example, a right to left taper opposite that shown in FIG. 2, or a taper extending from a central peak, not shown, outwardly toward said left and right sides 42 and 44, respectively. Deflector 40 is removably mounted on the flat portion 38 of main blade 24 using braces 46 and 48 welded to the snow deflector at left and right sides 42 and 44, respectively, and interior braces 50 and 52 spaced inwardly from left and right sides 42 and 44. Braces 46, 48, 50, and 52 are attached to corresponding braces 32 using bolts 54 threadingly engaging nuts 56 through mating holes in the respective braces and snow deflector 40 engages an abutment flange 58 at the uppermost end of the flat portion 38 of main blade 24. Although the illustrated embodiment includes a steel main blade 24 with braces 32 welded thereon, the present invention may also be implemented in conjunction with plastic snowplow moldboards and those of other materials as are known. Snowplow 2 further includes three damper spring mounting plates 60 welded between the three inner pairs of braces 32 as shown in FIG. 2 for connection to top ends 62 of damper springs 88 using adjustment nuts 64 as discussed further hereinafter.

Figure 3:
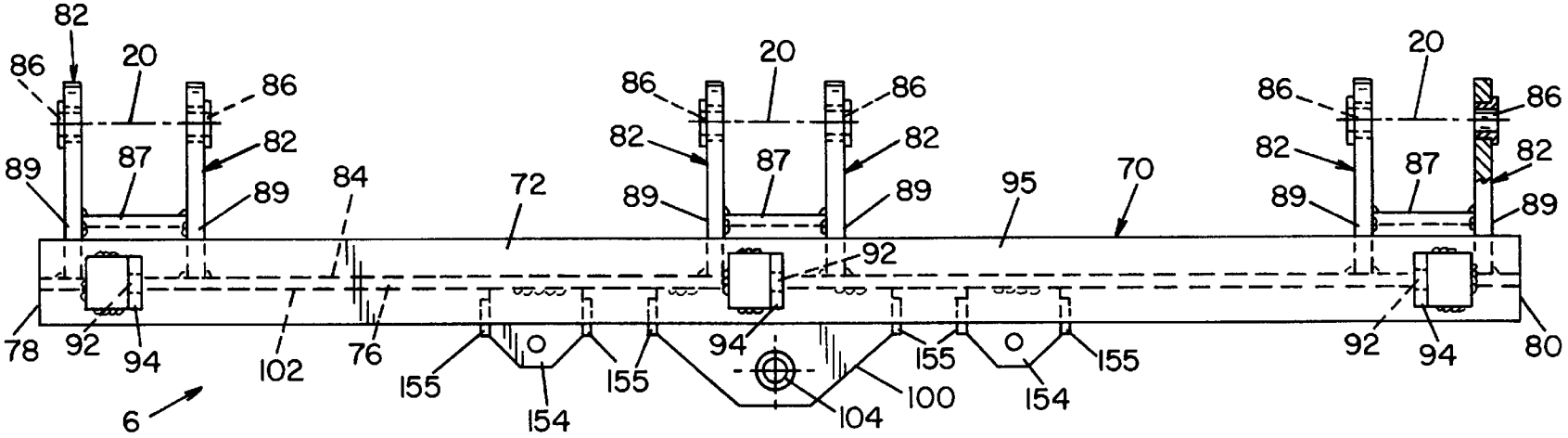
FIG. 3 is a plan view of a snowplow support member in accordance with the present invention.
Figure 4:
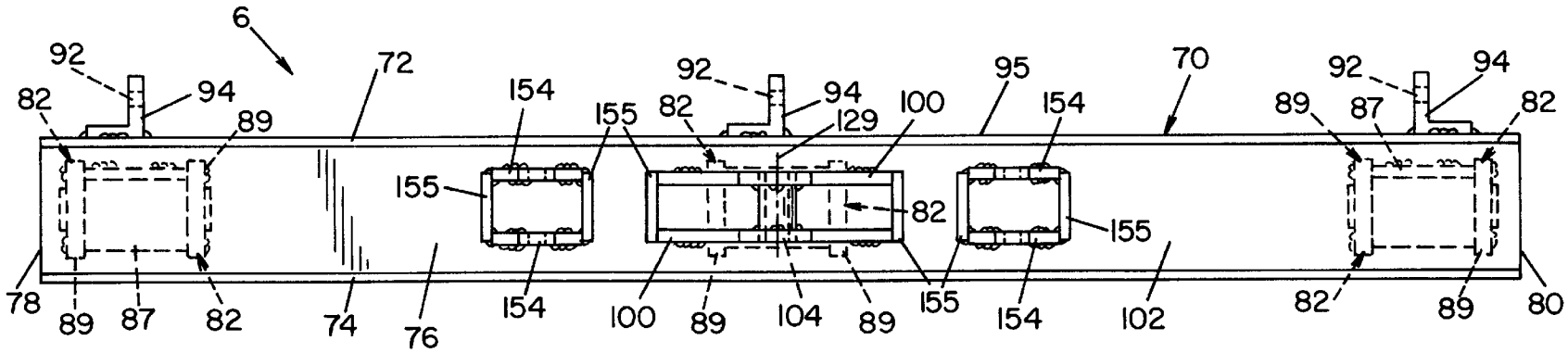
FIG. 4 is a front elevation view of the snowplow support member shown in FIGS. 1–3.
Figure 5:
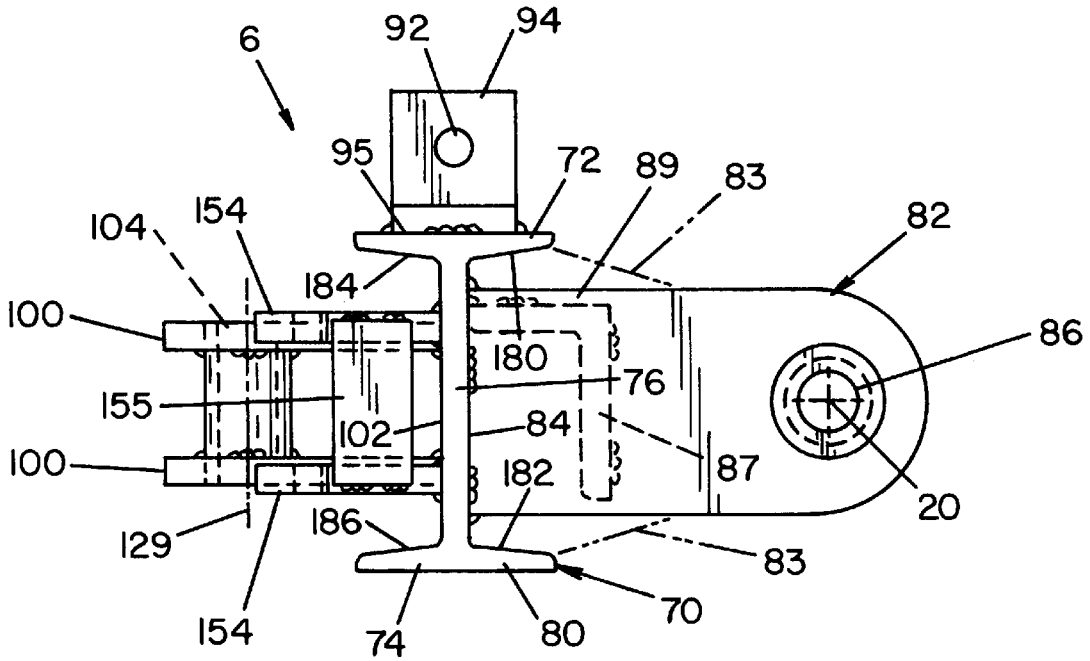
FIG. 5 is a side elevation view of the snowplow support member.

Referring also to FIGS. 3–5, mounting apparatus 6 includes an I-beam 70 having horizontal top and bottom flange members 72 and 74, respectively, and a vertical central member 76 extending parallel to horizontal axis 20 between a left end 78 and a right end 80 of I-beam 70. Although member 76 is illustrated in the drawings as being centrally located with respect to members 72 and 74, other embodiments are contemplated as within the scope of the invention wherein member 76 is offset from the lateral center of top and bottom flange members 72 and 74. Three blade attachment devises are provided by pairs of clevis plates 82 welded to central member front surface 84 and extend horizontally outward from surface 84. The three corresponding inner pairs of braces 32 are received between plates 82 and engage bolts 16 extending through holes 86 in clevis plates 82. Each pair of clevis plates 82 further includes an L-shaped support bracket 87 welded between the inner ends 89 of clevis plates 82. Snowplow 2 is thus pivotally mounted onto mounting apparatus 6 for movement relative to apparatus 6 about axis 20. Top ends 62 of springs 88 are threaded and are attached to mounting plates 60 using adjustment nuts 64. The springs have hook-shaped bottom ends 90 engaging holes 92 in L-shaped brackets 94 welded onto upper surface 95 of top member 72 of I-beam 70. Snowplow 2 is thereby biased upright with respect to mounting apparatus 6 for dampened pivotal movement about axis 20 upon snowplow 2 engaging obstructions on road surface R during a plowing operation. Mounting apparatus 6 further includes a clevis defined by a pair of vertically spaced clevis plates 100 centrally mounted on rear surface 102 of central member 76 of I-beam 70 between left and right ends 78 and 80 thereof.

Supporting frame 4 includes arms 110 extending from clevis plates 112 at an angle to left and right ends 114 and 116 of frame cross member 118. Clevis plates 112 have outer ends 120 extending above and below clevis plates 100 and are provided with holes 122 aligned with holes 104 in clevis plates 100. A bolt 124 extends vertically through holes 104 and 122 and receives a nut 126 and washers 128 to pivotally attach mounting apparatus 6 to supporting frame 4. Apparatus 6 is thus pivotal about bolt axis 129 relative to frame 4. Frame 4 further includes mounting ears 130 and ear plates 132 welded onto cross member 118 at left and right ends 114 and 116 thereof. Ears 130 include horizontal holes 134 for pivotally engaging frame F using pins 8 and nuts 136.

Control members or rams 140 provide control of the pivotal position of snowplow 2 relative to supporting frame 4. Cylinder ends 142 of rams 140 are engaged with trunnions 144 on the outward sides 146 of arms 110 using vertical bolts 148 and nuts 150. Piston rod ends 152 of rams 140 are engaged between clevis plates 154 welded onto rear surface 102 on either side of clevis plates 100 using vertical bolts 156 and nuts, not shown. Clevis plates 100 and clevis plates 154 further include vertical side plates 155 as shown in FIGS. 4 and 5. Lift arm 12 is used to controllably raise or lower supporting frame 4, and hence snowplow 2 using chain 14 which is fastened to clevis plates 112 by a pair of U-shaped bolts 160 mounted on L-shaped brackets 162 on outer sides of clevis plates 112 using nuts 164. Referring in particular to FIG. 5, although the various clevis plates 82, 100, and 154, as well as other structures have been illustrated in the preferred embodiment as being welded onto either the front surface 84 or the rear surface 102 of the vertical member 76, it will be appreciated that plates 82, 100, and 154 may also be welded onto I-beam front side flange inner surfaces 180 and 182 or rear side flange inner surfaces 184 and 186, alone or in combination with front or rear surfaces 84 and 102 respectively. In this manner, a stronger weld joint may be achieved for these clevis plates and other structures attached to the front or rear sides 84 or 102 of the support member I-beam 70. In this regard, clevis plates 82 may be alternatively fashioned to extend as shown in dashed lines 83 in FIG. 5, between flange inner surfaces 180 and 182, thus providing weldment surfaces for welding plates 82 on three surfaces.

Figure 6:
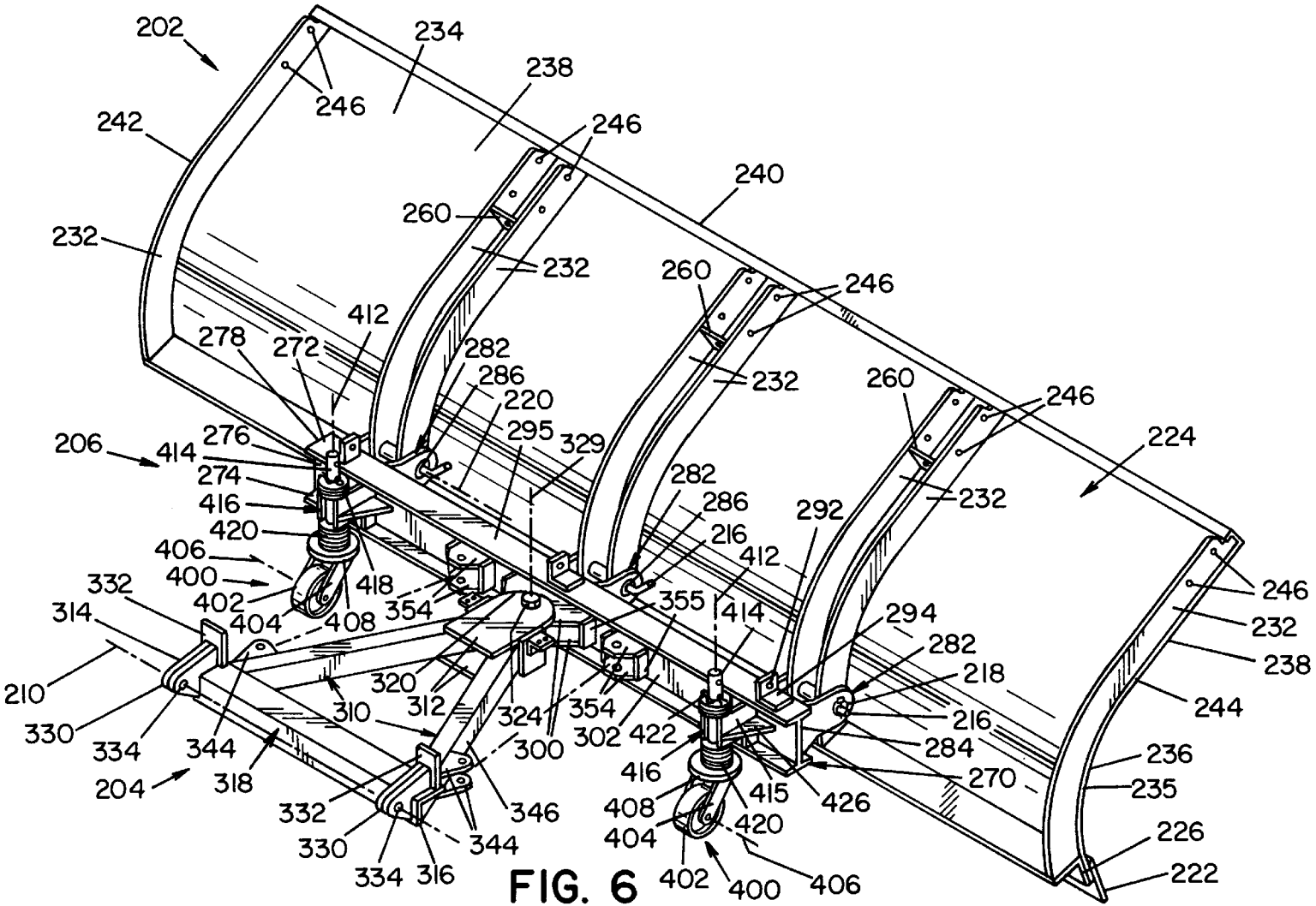
FIG. 6 is a perspective new of another embodiment of a vehicle snowplow mounting system including a support member and casters in accordance with the present invention.
Figure 7:
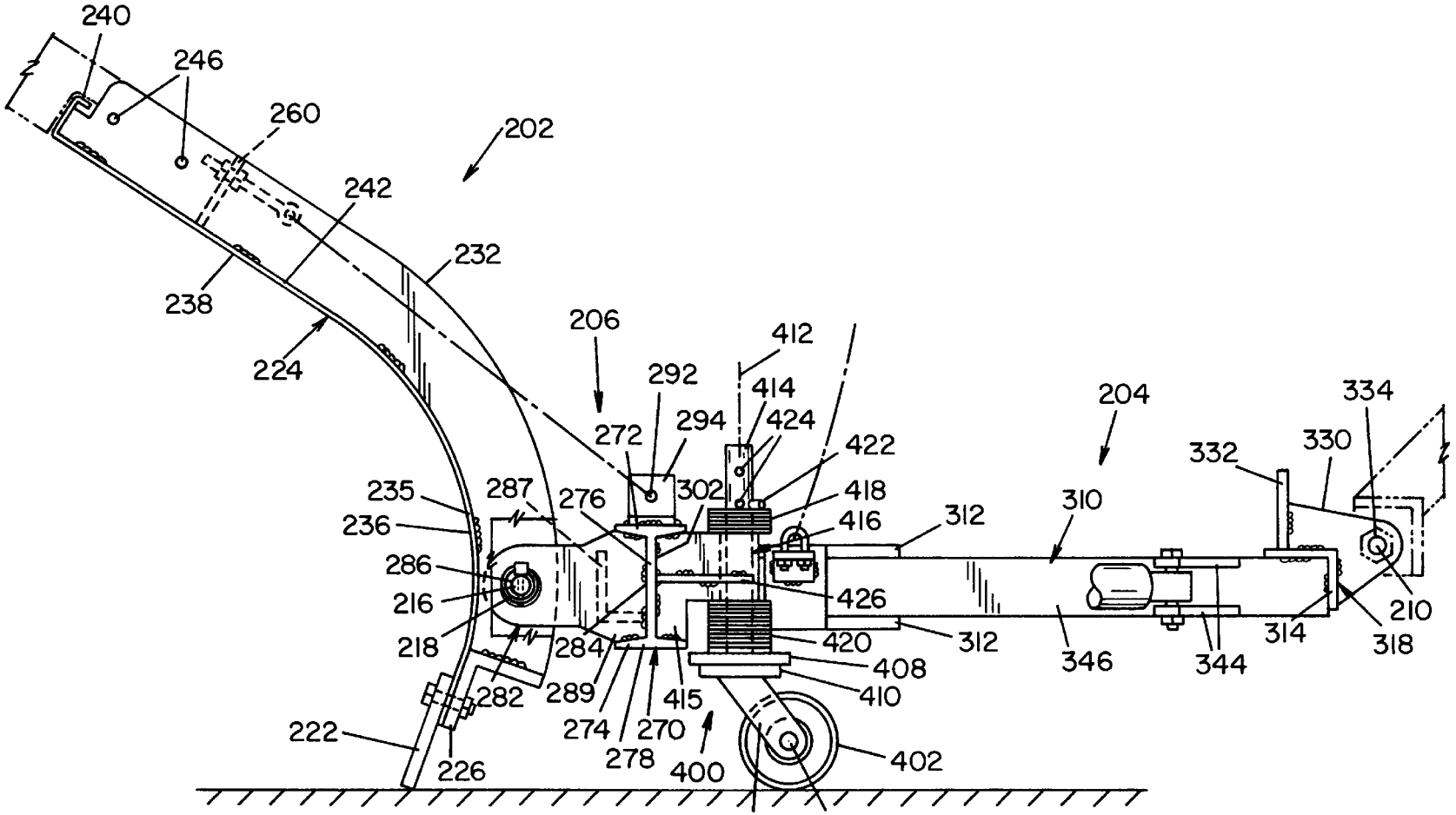
FIG. 7 is a side elevation view of the embodiment of FIG. 6.
Figure 8:
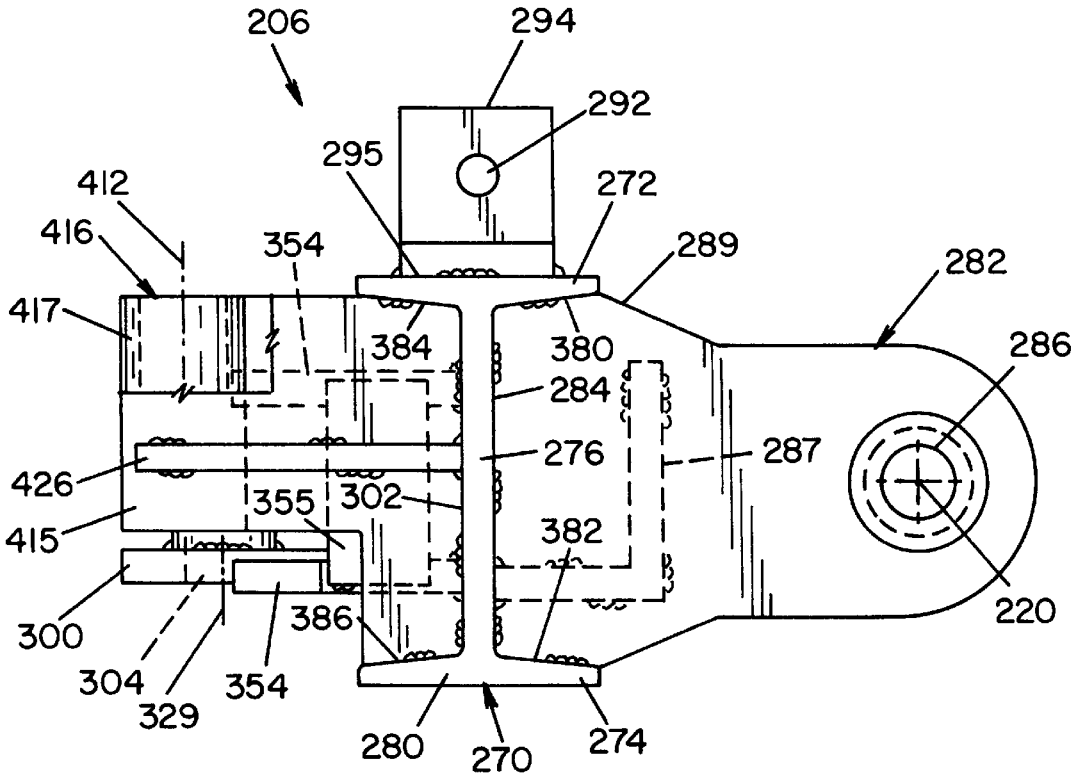
FIG. 8 is a side elevation view of the snowplow support member shown in FIGS. 6 and 7.
Figure 9:
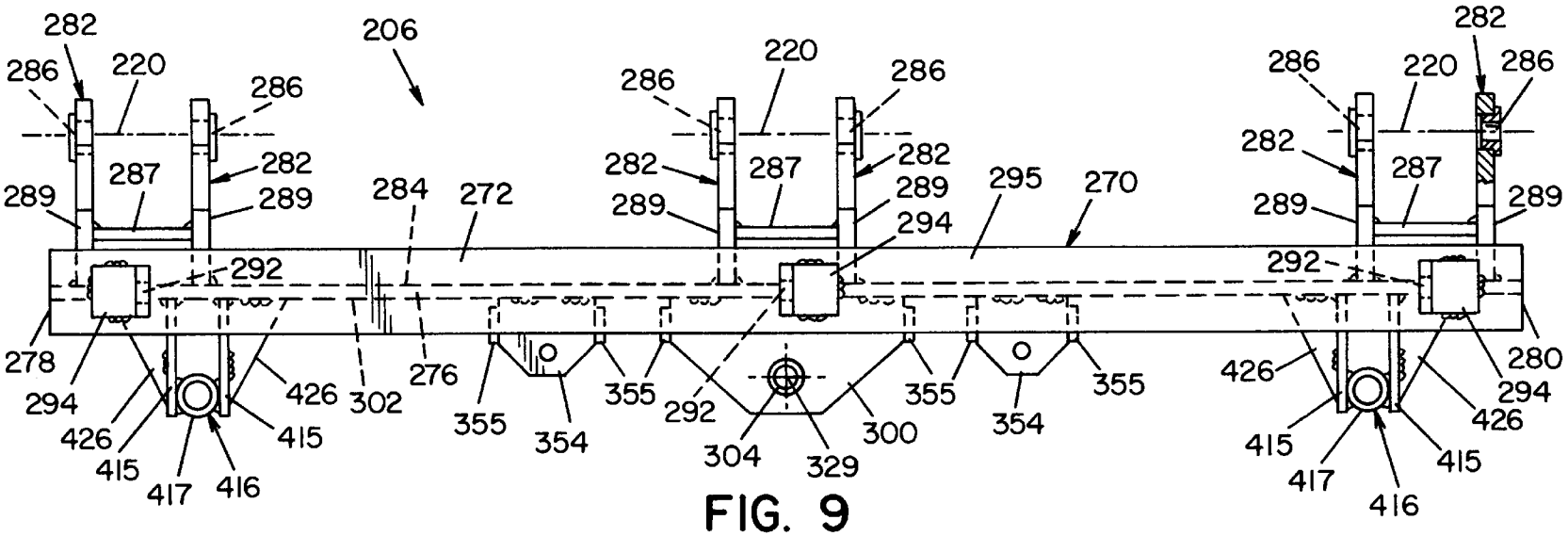
FIG. 9 is a plan view of the snowplow support member shown in FIGS. 6–8; and, FIG. 10 is a front elevation view of the snowplow support member of FIGS. 6–9.
Figure 10:
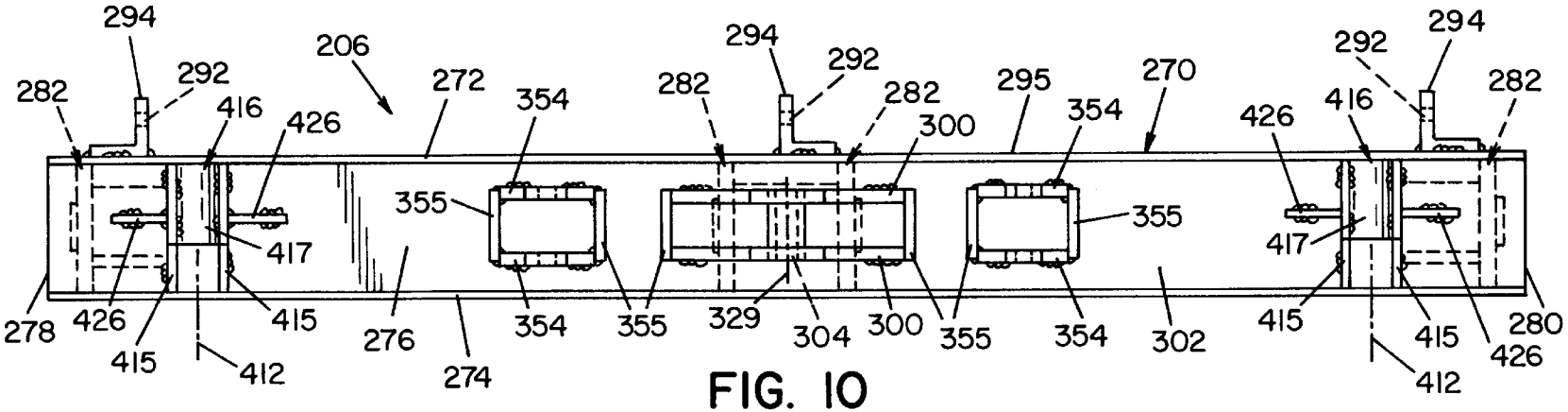

Referring now to FIGS. 6–10, wherein another embodiment of the present invention is illustrated, FIGS. 6 and 7 show a snowplow 202 mounted on a supporting frame 204 using mounting apparatus 206. Supporting frame 204 is adapted to be pivotally mounted on a vehicle frame using pins which provide a horizontal pivot axis 210 allowing snowplow 202 to be selectively raised and lowered using a lift arm and chain, not shown, in similar fashion to that of FIG. 1. Snowplow 202 is mounted on mounting apparatus 206 using pins 216 and flip pins 218 for pivotal movement with respect to apparatus 206 about horizontal axis 220. Snowplow 202 includes a scraper blade 222 mounted on a main blade 224 by an L-shaped mounting leg 226 on blade 224 and bolts, not shown. Snowplow 202 further includes braces 232 welded to main blade 224 along the back surface 234 of the blade. Main blade 224 has an arcuate portion 235 defining a concave front surface 236, and a flat portion 238 extending upwardly therefrom to a top side 240 which includes holes 246 in braces 232 for mounting a deflector, not shown, similar to that shown in FIGS. 1 and 2 to deflect plowed snow toward one or both of left and right sides 242 and 244, respectively, of blade 224. Although the embodiment of FIGS. 6–7 includes a steel main blade 224 with braces 232 welded thereon, the present invention may also be implemented in conjunction with plastic snowplow moldboards and those of other materials as are known. Snowplow 202 further includes three damper spring mounting plates 260 welded between the three inner pairs of braces 232 as shown in FIG. 6 for connection to damper springs, not shown, using adjustment nuts, not shown, in similar fashion to the embodiment of FIGS. 1 and 2. Referring also to FIGS. 8–10, mounting apparatus 206 includes an I-beam 270 having horizontal top and bottom flange members 272 and 274, respectively, and a vertical central member 276 extending parallel to horizontal axis 220 between a left end 278 and a right end 280 of I-beam 270. As with the embodiment of FIGS. 1–5, member 276 is illustrated in FIGS. 6–10 as being centrally located with respect to members 272 and 274. However, other embodiments are within the scope of the invention wherein member 276 is offset from the lateral center of top and bottom flange members 272 and 274. Three blade attachment devises are provided by pairs of clevis plates 282 welded to central member front surface 284 and extend horizontally outward from surface 284. The three corresponding inner pairs of braces 232 are received between plates 282 and engage pins 216 extending through holes 286 in clevis plates 282. Each pair of clevis plates 282 further includes an L-shaped support bracket 287 welded between the inner ends 289 of clevis plates 282. Snowplow 202 is thus pivotally mounted onto mounting apparatus 206 for movement relative to apparatus 206 about axis 220. Springs, not shown, are attached to mounting plates 260 using adjustment nuts, not shown, and engage holes 292 in L-shaped brackets 294 welded onto upper surface 295 of top member 272 of I-beam 270. Snowplow 202 is thereby biased upright with respect to mounting apparatus 206 for dampened pivotal movement about axis 220 upon snowplow 202 engaging obstructions on road surface, not shown, during a plowing operation. Mounting apparatus 206 further includes a clevis defined by a pair of vertically spaced clevis plates 300 centrally mounted on rear surface 302 of central member 276 of I-beam 270 between left and right ends 278 and 280 thereof.

Supporting frame 204 includes arms 310 extending from clevis plates 312 at an angle to left and right ends 314 and 316 of frame cross member 318. Clevis plates 312 have outer ends 320 extending above and below clevis plates 300 and are provided with holes, not shown, aligned with holes 304 in clevis plates 300. A bolt 324 extends vertically through holes 304 of clevis plates 300 and the corresponding holes in clevis plates 312, and receives a nut and washers, not shown, to pivotally attach mounting apparatus 206 to supporting frame 204. Apparatus 206 is thus pivotal about bolt axis 329 relative to frame 204. Frame 204 further includes mounting ears 330 and ear plates 332 welded onto cross member 318 at left and right ends 314 and 316 thereof. Ears 330 include horizontal holes 334 for pivotally engaging a vehicle frame, not shown, using pins and nuts, not shown.

Control of the pivotal position of snowplow 202 relative to supporting frame 204 is provided by control members or rams, not shown, engaging with trunnions 344 on the outward sides 346 of arms 310 using vertical bolts and nuts, not shown, as well as engaging clevis plates 354 welded onto rear surface 302 on either side of clevis plates 300 using vertical bolts and nuts, not shown. Clevis plates 300 and clevis plates 354 further include vertical side plates 355. Although the various clevis plates 282, 300, and 354, as well as other structures have been illustrated in the embodiment as being welded onto either the front surface 284 or the rear surface 302 of the vertical member 276, it will be appreciated that plates 282, 300 and 354 may also be welded onto I-beam front side flange inner surfaces 380 and 382 or rear side flange inner surfaces 384 and 386, alone or in combination with front or rear surfaces 284 and 302, respectively. In this manner, a stronger weld joint may be achieved for these clevis plates and other structures attached to the front or rear sides 284 or 302 of the support member I-beam 270, as is more clearly shown in FIG. 8 wherein clevis plates 282 extend vertically between surfaces 382 and 384. This provides for welding of plates 282 to I-beam 270 on three surfaces, namely surfaces 382, 384, and 284, thus strengthening the finished assembly.

Referring now in particular to FIGS. 6 and 7, mounting apparatus 206 optionally includes two caster assemblies 400 used to provide a gap between a road surface being plowed and the bottom edge of scraper blade 222, thereby preventing or reducing road damage. Each assembly 400 includes a caster wheel 402 mounted between arms 404 for rotation about horizontal axis 406 and supported on the bottom of a generally horizontal base 408 by a pivotal bearing 410 allowing the wheel 402 and arms 404 to pivot about a generally vertical axis 412. A shaft 414 extends vertically upwardly from base 408 along axis 412 through a mounting bracket 416 and upper and lower stacks of washers 418 and 420, respectively, and is removably engaged therewith by a pin 422 passing through a horizontal hole 424 in shaft 414. Bracket 416 extends vertically between inner flange surfaces 384 and 386 and is welded thereto as well as to rear surface 302 of I-beam 270, and includes horizontal braces 426, sidewalls 415, and a cylindrical collar 417. Pin 422 prevents disengagement of caster shaft 414 from bracket 416 by providing an abutment with upper washers 418. Lower washers 420 support the load of the snowplow against caster base 408. Vertical adjustment of wheels 402 relative to the scraper blade 222 is accomplished by removing pin 422 from hole 424 allowing downward disengagement of shaft 414 from bracket 416 and upper washers 418. Individual washers may then be reallocated between upper and lower washer sets 418 and 420, respectively, in order to change the vertical position of wheel 402 with respect to scraper blade 222. Once the washers are reconfigured, shaft 414 is reinserted vertically upwardly through bracket 416 and upper washers 418, and pin 422 is reinserted through hole 424 to prevent disengagement of shaft 414 from bracket 416. The adjustable caster system thus provided is simple, cost effective, and easily maintained.

As many possible embodiments of the present invention may be made and as many possible changes may be made in the embodiment set forth herein, it is to be distinctly understood that the foregoing descriptive matter is to be interpreted merely as an illustration of a specific embodiment of the invention, and not as a limitation thereof. It is applicant's intent to include all embodiments within the scope of the accompanying claims and all equivalents thereof.

Having thus described the invention, the following is claimed:

1. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, said vertical member being transversely centrally located with respect to said top and bottom members, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade; and attachment means on said front side for attaching said snowplow blade to said support member.

2. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade; and, attachment means on said front side for attaching said snowplow blade to said support member, said attachment means including a U-shaped clevis having open and closed ends, said closed end being mounted on said front side, said open end facing outwardly from said front side and having a first pair of holes defining a snowplow blade mounting axis parallel with said longitudinal axis, said snowplow blade having a second pair of holes adapted to be aligned with said first pair of holes to receive a pin supporting said snowplow blade for pivotal displacement about said mounting axis.

3. The apparatus of claim 2, wherein said closed end of said U-shaped clevis extends vertically between said upper surface of said bottom member and said lower surface of said top member; said closed end being mounted to at least one of said vertical member, said upper surface of said bottom member and said lower surface of said top member on said front side of said support member.

4. The apparatus of claim 2, wherein said attachment means further includes a spring having opposite ends and spring connection means on said top member for connecting one end of said spring to said top member, the other end of said spring being attached to said snowplow blade to provide damped pivoting of said snowplow blade about said mounting axis.

5. The apparatus of claim 4, wherein said spring connection means includes an L-shaped bracket having a lower portion mounted on said top member and an upper portion extending upwardly from said top member with a hole for connecting said one end of said spring to said bracket.

6. The apparatus of claim 5, wherein said means for mounting said support member on said supporting frame includes a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

7. The apparatus of claim 6, wherein said means for connecting said support member to said controls includes a U-shaped clevis having open and closed ends, said closed end being mounted on said rear side and longitudinally spaced from said means for mounting said support member on said supporting frame, said open end facing outwardly from said rear side and having a first pair of holes providing a vertical control axis, said controls including a control member having a second pair of holes adapted to be aligned with said first pair of holes to receive a pin engaging said control member and clevis.

8. The apparatus of claim 5, wherein said means for connecting said support member to said controls includes a U-shaped clevis having open and closed ends, said closed end being mounted on said rear side and longitudinally spaced from said means for mounting said support member on said supporting frame, said open end facing outwardly from said rear side and having a first pair of holes providing a vertical control axis, said controls including a control member having a second pair of holes adapted to be aligned with said first pair of holes to receive a pin engaging said control member and clevis.

9. The apparatus of claim 2, wherein said means for mounting said support member on said supporting frame includes a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

10. The apparatus of claim 2, wherein said means for connecting said support member to said controls includes a U-shaped clevis having open and closed ends, said closed end being mounted on said rear side and longitudinally spaced from said means for mounting said support member on said supporting frame, said open end facing outwardly from said rear side and having a first pair of holes providing a vertical control axis, said controls having a second pair of holes adapted to be aligned with said first pair of holes to receive a pin engaging said controls.

11. The apparatus of claim 2, further comprising a caster mounted on said support member with adjustment means for vertically positioning said caster with respect to said support member.

12. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade; and, attachment means on said front side for attaching said snowplow blade to said support member;

said means for mounting said support member on said supporting frame including a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

13. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade; and, attachment means on said front side for attaching said snowplow blade to said support member;

said means for connecting said support member to said controls including a U-shaped clevis having open and closed ends, said closed end being mounted on said rear side and longitudinally spaced from said means for mounting said support member on said supporting frame, said open end facing outwardly from said rear side and having a first pair of holes providing a vertical control axis, said controls including a control member having a second pair of holes adapted to be aligned with said first pair of holes to receive a pin engaging said control member and clevis.

14. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade; and, attachment means on said front side for attaching said snowplow blade to said support member, said attachment means including a spring having opposite ends and spring connection means on said top member for connecting one end of a spring to said top member, the other end of said spring being attached to said snowplow blade to provide damped pivoting of said snowplow blade about said snowplow blade mounting axis.

15. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said support member having laterally opposite front and rear sides, and said top and bottom members each extending in laterally opposite directions from said vertical member and each having upper and lower generally horizontal surfaces;

means on said rear side for mounting said support member on said snowplow supporting frame for pivotal movement about a vertical axis;

means spaced longitudinally from said pivot means on said rear side for connecting said support member to said controls for positioning said snowplow blade;

attachment means on said front side for attaching said snowplow blade to said support member; and, a caster mounted on said support member with adjustment means for vertically positioning said caster with respect to said support member, said caster including a shaft with an axis extending upwardly from a base, a wheel mounted beneath said base for pivotal rotation about a horizontal axis, a bracket mounted on said support member with vertically opposite top and bottom sides and engaging said shaft; said adjustment means including abutment means engaging said shaft for preventing disengagement of said shaft from said bracket, and load carrying means between said base and said bracket for supporting said bracket vertically above said base.

16. The apparatus of claim 15, wherein said abutment means for preventing disengagement of said shaft from said bracket includes a hole extending horizontally through said shaft and a pin removably engaging said hole with an abutment surface extending horizontally beyond said shaft, and at least one spacer encircling said shaft between said top side of said bracket and said pin; and said load carrying means including at least one spacer encircling said shaft between said bottom side of said bracket and said base.

17. The apparatus of claim 16, wherein said spacers are washers.

18. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said top and bottom members each extending in laterally opposite directions from said vertical member and each having generally horizontal upper and lower surfaces, said vertical member being transversely centrally located with respect to said top and bottom members, and said support member having laterally opposite front and rear sides;

mounting means on said rear side for mounting said support member on said snowplow supporting frame; and attachment means on said front side for attaching said snowplow blade to said support member.

19. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said top and bottom members each extending in laterally opposite directions from said vertical member and each having generally horizontal upper and lower surfaces, and said support member having laterally opposite front and rear sides;

mounting means on said rear side for mounting said support member on said snowplow supporting frame; and attachment means on said front side for attaching said snowplow blade to said support member;

said mounting means including a U-shaped clevis having open and closed ends, said closed end being mounted on said rear side, said open end facing outwardly from said rear side and having a first pair of holes defining a vertical axis, said supporting frame having a second pair of holes adapted to be aligned with said first pair of holes to receive a pin supporting said support member for pivotal displacement about said vertical axis.

20. The apparatus of claim 19, wherein said closed end of said U-shaped clevis extends vertically between said upper surface of said bottom member and said lower surface of said top member; said closed end being mounted to at least one of said vertical member, said upper surface of said bottom member, and said lower surface of said top member on said front side of said support member.

21. The apparatus of claim 19, further including means for connecting said support member to said controls spaced longitudinally from said mounting means on said rear side.

22. The apparatus of claim 21, wherein said means for connecting said support member to said controls includes a U-shaped clevis having open and closed ends, said closed end being mounted on said rear side and longitudinally spaced from said mounting means, said open end facing outwardly from said rear side and having a first pair of holes providing a vertical control axis, said controls having a second pair of holes adapted to be aligned with said first pair of holes to receive a pin engaging said controls.

23. The apparatus of claim 19, further comprising a caster mounted on said support member with adjustment means for vertically positioning said caster with respect to said support member.

24. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said top and bottom members each extending in laterally opposite directions from said vertical member and each having generally horizontal upper and lower surfaces, and said support member having laterally opposite front and rear sides;

mounting means on said rear side for mounting said support member on said snowplow supporting frame; and attachment means on said front side for attaching said snowplow blade to said support member, said attachment means including a U-shaped clevis having open and closed ends, said closed end being mounted on said front side, said open end facing outwardly from said front side and having a first pair of holes defining a snowplow blade mounting axis parallel with said longitudinal axis, said snowplow blade having a second pair of holes adapted to be aligned with said first pair of holes to receive a pin supporting said snowplow blade for pivotal displacement about said mounting axis.

25. The apparatus of claim 24, wherein said attachment means further includes a spring having opposite ends and spring connection means on said top member for connecting one end of said spring to said top member, wherein the other end of said spring is attached to said snowplow blade to provide damped pivoting of said snowplow blade about said snowplow blade mounting axis.

26. The apparatus of claim 25, wherein said spring connection means includes an L-shaped bracket having a lower portion mounted on said top member and an upper portion extending upwardly from said top member with a hole for connecting said one end of said spring to said bracket.

27. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said top and bottom members each extending in laterally opposite directions from said vertical member and each having generally horizontal upper and lower surfaces, and said support member having laterally opposite front and rear sides;

mounting means on said rear side for mounting said support member on said snowplow supporting frame; and attachment means on said front side for attaching said snowplow blade to said support member, said attachment means including a spring having opposite ends and spring connection means on said top member for connecting one end of said spring to said top member, wherein the other end of said spring is attached to said snowplow blade to provide damped pivoting of said snowplow blade about said snowplow blade mounting axis.

28. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said top and bottom members each extending in laterally opposite directions from said vertical member and each having generally horizontal upper and lower surfaces, and said support member having laterally opposite front and rear sides;

mounting means on said rear side for mounting said support member on said snowplow supporting frame;

attachment means on said front side for attaching said snowplow blade to said support member; and, a caster mounted on said support member with adjustment means for vertically positioning said caster with respect to said support member, said caster including a shaft with an axis extending upwardly from a base, a wheel mounted beneath said base for pivotal rotation about a horizontal axis, a bracket mounted on said support member with vertically opposite top and bottom sides and engaging said shaft; said adjustment means including abutment means engaging said shaft for preventing disengagement of said shaft from said bracket, and load carrying means engaging said shaft between said base and said bracket for supporting said bracket vertically above said base.

29. The apparatus of claim 28, wherein said abutment means for preventing disengagement of said shaft from said bracket includes a hole extending horizontally through said shaft and a pin removably engaging said hole with an abutment surface extending horizontally beyond said shaft, and at least one spacer encircling said shaft between said top side of said bracket and said pin; and said load carrying means including at least one spacer encircling said shaft between said bottom side of said bracket and said base.

30. The apparatus of claim 29, wherein said spacers are washers.

31. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said vertical member having transverse front and rear surfaces opposite one another, said vertical member being transversely centrally located with respect to said top and bottom members, and said top and bottom members each extending in transversely opposite directions from said vertical member and each having generally horizontal upper and lower surfaces;

pivot means on said rear surface for mounting said support member on said snowplow supporting frame for pivotal movement about a vertical axis; and attachment means on said front surface for attaching said snowplow blade to said support member.

32. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said vertical member having transverse front and rear surfaces opposite one another, and said top and bottom members each extending in transversely opposite directions from said vertical member and each having generally horizontal upper and lower surfaces;

pivot means on said rear surface for mounting said support member on said snowplow supporting frame for pivotal movement about a vertical axis; and attachment means on said front surface for attaching said snowplow blade to said support member, said attachment means including a spring having opposite ends and spring connection means on said top member for connecting one end of a spring to said top member, the other end of said spring being attached to said snowplow blade to provide damped pivoting of said snowplow blade about said snowplow blade mounting axis.

33. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said vertical member having transverse front and rear surfaces opposite one another, and said top and bottom members each extending in transversely opposite directions from said vertical member and each having generally horizontal upper and lower surfaces;

pivot means on said rear surface for mounting said support member on said snowplow supporting frame for pivotal movement about a vertical axis; and attachment means on said front surface for attaching said snowplow blade to said support member, said attachment means including a U-shaped clevis having open and closed ends, said closed end being mounted on said front side, said open end facing outwardly from said front side and having a first pair of holes defining a snowplow blade mounting axis parallel with said longitudinal axis, said snowplow blade having a second pair of holes adapted to be aligned with said first pair of holes to receive a pin supporting said snowplow blade for pivotal displacement about said mounting axis.

34. The apparatus of claim 33, wherein said closed end of said U-shaped clevis extends vertically between said upper surface of said bottom member and said lower surface of said top member; said closed end being mounted to at least one of said vertical member, said upper surface of said bottom member, and said lower surface of said top member on said front side of said support member.

35. The apparatus of claim 33, wherein said attachment means further includes a spring having opposite ends and spring connection means on said top member for connecting one end of said spring to said top member, the other end of said spring being attached to said snowplow blade to provide damped pivoting of said snowplow blade about said mounting axis.

36. The apparatus of claim 35, wherein said spring connection means includes an L-shaped bracket having a lower portion mounted on said top member and an upper portion extending upwardly from said top member with a hole for connecting said one end of said spring to said bracket.

37. The apparatus of claim 36, wherein said means for mounting said support member on said supporting frame includes a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

38. The apparatus of claim 33, further including a control connector spaced longitudinally from said pivot means on said rear surface and adapted to connect said support member to said controls for positioning said frame and said snowplow blade relative to said vehicle.

39. The apparatus of claim 38, wherein said vertical member is transversely centrally located with respect to said top and bottom members.

40. The apparatus of claim 33, further comprising a caster mounted on said support member with adjustment means for vertically positioning said caster with respect to said support member.

41. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said vertical member having transverse front and rear surfaces opposite one another, and said top and bottom members each extending in transversely opposite directions from said vertical member and each having generally horizontal upper and lower surfaces;

pivot means on said rear surface for mounting said support member on said snowplow supporting frame for pivotal movement about a vertical axis; and attachment means on said front surface for attaching said snowplow blade to said support member;

said means for mounting said support member on said supporting frame including a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

42. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical member extending therebetween, said top, bottom, and vertical members extending horizontally along a longitudinal axis between first and second ends, said vertical member having transverse front and rear surfaces opposite one another, and said top and bottom members each extending in transversely opposite directions from said vertical member and each having generally horizontal upper and lower surfaces;

pivot means on said rear surface for mounting said support member on said snowplow supporting frame for pivotal movement about a vertical axis;

attachment means on said front surface for attaching said snowplow blade to said support member; and, a control connector spaced longitudinally from said pivot means on said rear surface and adapted to connect said support member to said controls for positioning said frame and said snowplow blade relative to said vehicle;

said attachment means including a U-shaped clevis having open and closed ends, said closed end being mounted on said front side, said open end facing outwardly from said front side and having a first pair of holes defining a snowplow blade mounting axis parallel with said longitudinal axis, said snowplow blade having a second pair of holes adapted to be aligned with said first pair of holes to receive a pin supporting said snowplow blade for pivotal displacement about said mounting axis.

43. The apparatus of claim 42, wherein said attachment means further includes a spring having opposite ends and spring connection means on said top member for connecting one end of said spring to said top member, the other end of said spring being attached to said snowplow blade to provide damped pivoting of said snowplow blade about said mounting axis.

44. The apparatus of claim 43, wherein said spring connection means includes an L-shaped bracket having a lower portion mounted on said top member and an upper portion extending upwardly from said top member with a hole for connecting said one end of said spring to said bracket.

45. The apparatus of claim 44, wherein said pivot means includes a U-shaped clevis having open and closed ends, said closed end being mounted on said rear side, said open end facing outwardly from said rear side and having a first pair of holes providing said vertical axis, said supporting frame having a second pair of holes adapted to be aligned with said first pair of holes to receive a pin supporting said support member for pivotal displacement about said vertical axis.

46. Apparatus for mounting a snowplow blade onto a vehicle-mounted snowplow supporting frame, said vehicle equipped with controls for positioning said frame and said snowplow blade relative to said vehicle, said apparatus comprising:

a support member having horizontal top and bottom members and a vertical members extending therebetween, said top, bottom, and vertical members extending horizontally along a longitudinal axis between first and second ends, said vertical member having transverse front and rear surfaces opposite one another, and said top and bottom members each extending in transversely opposite directions from said vertical member and each having generally horizontal upper and lower surfaces;

pivot means on said rear surface for mounting said support member on said snowplow supporting frame for pivotal movement about a vertical axis;

attachment means on said front surface for attaching said snowplow blade to said support member; and, a caster mounted on said support member with adjustment means for vertically positioning said caster with respect to said support member, said caster including a shaft with an axis extending upwardly from a base, a wheel mounted beneath said base for pivotal rotation about a horizontal axis, a bracket mounted on said support member with vertically opposite top and bottom sides and engaging said shaft; said adjustment means including abutment means engaging said shaft for preventing disengagement of said shaft from said bracket, and load carrying means engaging said shaft between said base and said bracket for supporting said bracket vertically above said base.

47. The apparatus of claim 46, wherein said abutment means for preventing disengagement of said shaft from said bracket includes a hole extending horizontally through said shaft and a pin removably engaging said hole with an abutment surface extending horizontally beyond said shaft, and at least one spacer encircling said shaft between said top side of said bracket and said pin; and said load carrying means including at least one spacer encircling said shaft between said bottom side of said bracket and said base.

48. The apparatus of claim 47, wherein said spacers are washers.

* * * * *